US008237583B2

(12) United States Patent
Mitchell et al.

(10) Patent No.: US 8,237,583 B2
(45) Date of Patent: Aug. 7, 2012

(54) METHOD AND SYSTEM FOR VITAL DISPLAY SYSTEMS

(75) Inventors: Michael Scott Mitchell, Lee's Summit, MO (US); Samuel Robert Mollet, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 785 days.

(21) Appl. No.: 12/265,542

(22) Filed: Nov. 5, 2008

(65) Prior Publication Data

US 2010/0109899 A1 May 6, 2010

(51) Int. Cl.
*G08B 5/36* (2006.01)

(52) U.S. Cl. ..... 340/815.53; 340/642; 340/643; 340/691.1; 340/691.6; 340/332; 340/815.73; 345/204; 345/207

(58) Field of Classification Search ..... 340/815.53, 340/641, 642, 643, 691.1, 691.6, 332, 815.73; 345/204, 207, 168, 92, 98, 87; 257/290, 257/291, 292, 88; 349/116; 348/349, 207
See application file for complete search history.

(56) References Cited

U.S. PATENT DOCUMENTS

| | | | | |
|---|---|---|---|---|
| RE33,894 | E | 4/1992 | Bradley | |
| 5,433,111 | A | 7/1995 | Hershey et al. | |
| 5,845,272 | A | 12/1998 | Morjaria et al. | |
| 5,961,567 | A | 10/1999 | Azzaro et al. | |
| 6,377,876 | B1 | 4/2002 | Hedeen et al. | |
| 6,676,089 | B1 | 1/2004 | Katzer | |
| 6,702,235 | B2 | 3/2004 | Katzer | |
| 6,909,945 | B2 | 6/2005 | Katzer | |
| 7,209,812 | B2 | 4/2007 | Katzer | |
| 7,216,836 | B2 | 5/2007 | Katzer | |
| 2002/0154098 | A1 * | 10/2002 | Metz | 345/173 |
| 2005/0253834 | A1 * | 11/2005 | Sakamaki et al. | 345/207 |
| 2006/0100753 | A1 | 5/2006 | Katzer | |
| 2006/0226298 | A1 | 10/2006 | Pierson | |
| 2010/0093400 | A1 * | 4/2010 | Ju et al. | 455/566 |
| 2011/0087981 | A1 * | 4/2011 | Jeong et al. | 715/765 |
| 2011/0307508 | A1 * | 12/2011 | Arreola | 707/769 |

* cited by examiner

*Primary Examiner* — Daryl Pope
(74) *Attorney, Agent, or Firm* — GE Global Patent Operation; John A. Kramer

(57) ABSTRACT

A method and system for a display system is provided. The system includes a screen surface that includes a plurality of luminous units, a controller communicatively coupled to the screen surface wherein the controller is configured to address at least one of the plurality of luminous units, and a luminous unit sensor having a field of view including at least a portion of the screen surface wherein the luminous unit sensor configured to receive an image of the luminous units in the field of view.

20 Claims, 2 Drawing Sheets

METHOD AND SYSTEM FOR VITAL DISPLAY SYSTEMS

BACKGROUND OF THE INVENTION

This invention relates generally to vital control and display systems and, more particularly, to vital control and display systems that ensure current information is displayed.

At least some known operator interfaces include video or screen displays that are updated to display current information on a periodic basis. Information that is changing may be easily discernable as being current if the change in the displayed information is observed. However, during some steady state conditions, information displayed may not be changing frequently or the change in the information may not be observed. In such cases, a question of whether the information displayed is current information or old information arises. Some known methods of attempting to verify that displayed information is current include a "refresh" button that causes the display driver to request new information from at least some of the systems supplying the information. The display driver then retransmits the information to the display. However, unless the information is changed from the previously displayed information, there is no way to be certain the information is updated. Another method includes displaying a clock in a portion of the screen. However, the clock display may only indicate that the portion of the screen where the clock is located is being updated. The remainder of the screen may not be updated with current information.

BRIEF DESCRIPTION OF THE INVENTION

In one embodiment, a screen display system includes a screen surface that includes a plurality of luminous units, a controller communicatively coupled to the screen surface wherein the controller is configured to address at least one of the plurality of luminous units, and a luminous unit sensor having a field of view including at least a portion of the screen surface wherein the luminous unit sensor configured to receive an image of the luminous units in the field of view.

In another embodiment, a method of monitoring the operability of a display includes periodically displaying an icon on a screen surface, acquiring an image of the displayed icon, and outputting an alert if the image of the icon is not acquired within a predetermined time period.

In yet another embodiment, a display system includes a display device comprising a screen surface configured to display an icon, a controller communicatively coupled to said display device, said controller configured to control the location of the display of the icon, and a display sensor configured to receive an image of the icon on the screen surface.

BRIEF DESCRIPTION OF THE DRAWINGS

FIG. 1 is a partial cut away view of an exemplary locomotive;

FIG. 2 is a perspective view of operator display system shown in FIG. 1 in accordance with an embodiment of the present invention; and FIG. 3 is a perspective view of operator display system shown in FIG. 1 in accordance with another embodiment of the present invention.

DETAILED DESCRIPTION OF THE INVENTION

The following detailed description illustrates embodiments of the invention by way of example and not by way of limitation. It is contemplated that the invention has general application to display systems in industrial, commercial, and residential applications.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
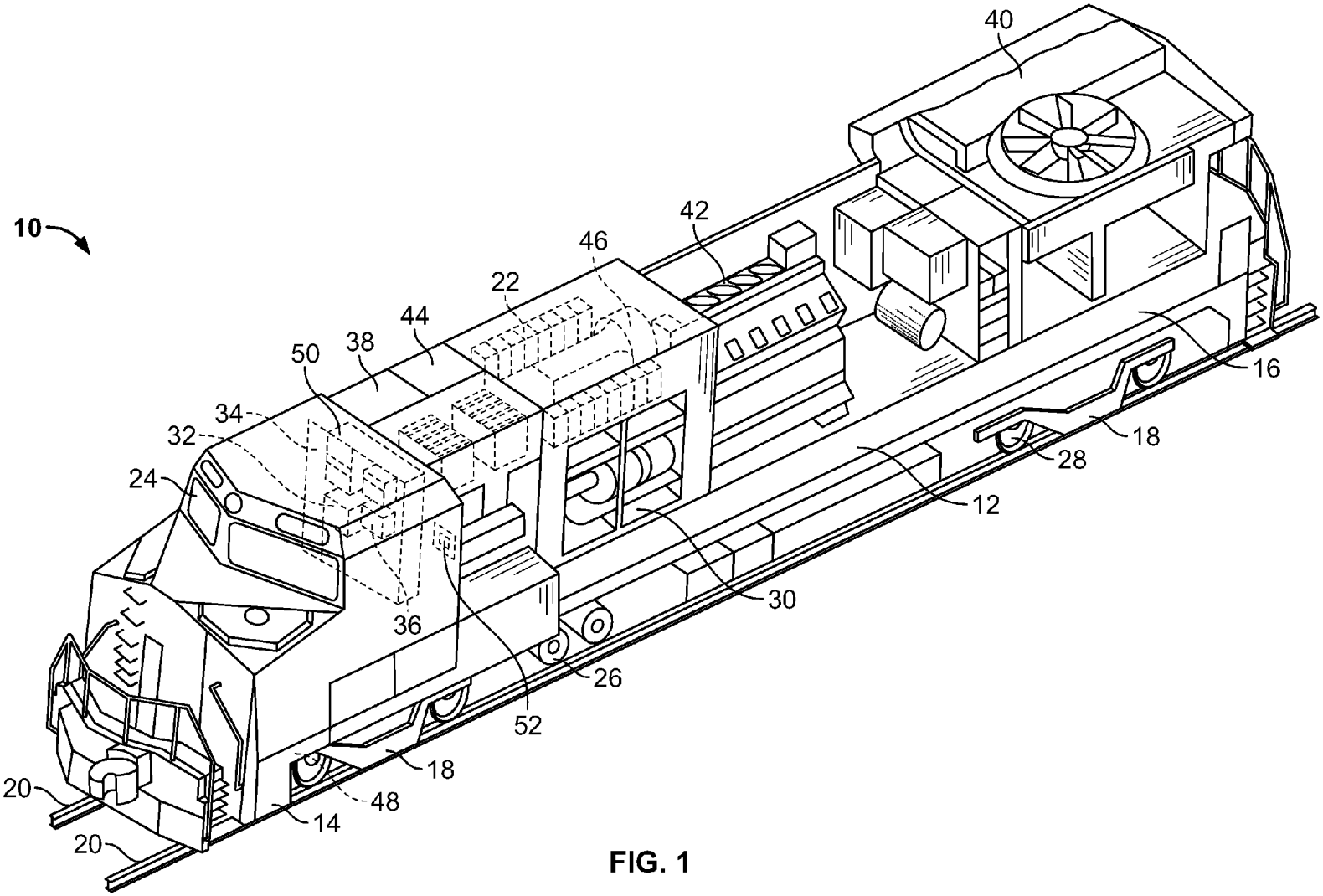
FIGS. 1-3 show exemplary embodiments of the method and system described herein.

FIG. 1 is a partial cut away view of an exemplary locomotive 10. Locomotive 10 includes a platform 12 having a first end 14 and a second end 16. A propulsion system 18, or truck is coupled to platform 12 for supporting, and propelling platform 12 on a pair of rails 20. An equipment compartment 22 and an operator cab 24 are coupled to platform 12. An air and air brake system 26 provides compressed air to locomotive 10, which uses the compressed air to actuate a plurality of air brakes 28 on locomotive 10 and railcars (not shown) behind it. An auxiliary alternator system 30 supplies power to all auxiliary equipment. An intra-consist communications system 32 collects, distributes, and displays consist data across all locomotives in a consist.

A cab signal system 34 links the wayside (not shown) to a train control system 36 or air brake system 26. In particular, system 34 receives coded signals from a pair of rails 20 through track receivers (not shown) located on the front and rear of the locomotive. The information received is used to inform the locomotive operator of the operating mode. A distributed power control system 38 enables remote control capability of multiple locomotive consists coupled in the train. System 38 also provides for control of tractive power in motoring and braking, as well as air brake control.

An engine cooling system 40 enables engine 42 and other components to reject heat to cooling water. In addition, system 40 facilitates minimizing engine thermal cycling by maintaining an optimal engine temperature throughout the load range, and facilitates preventing overheating in tunnels. An equipment ventilation system 44 provides cooling to locomotive 10 equipment.

A traction alternator system 46 converts mechanical power to electrical power which is then provided to propulsion system 18. Propulsion system 18 enables locomotive 10 to move and includes at least one traction motor 48 and dynamic braking capability. In particular, propulsion system 18 receives power from traction alternator 46, and through traction motors 48 moves locomotive 10. Locomotive 10 systems are monitored by an on-board monitor (OBM) system 50. OBM system 50 keeps track of incidents occurring in the systems with an incident log. An operator display system 52 provides an operator with graphical, textual, and/or aural information regarding the status and operation of locomotive 10 and associated rolling stock (not shown) as well as track conditions, operating limits and instructions. Operator display system 52 may include information of a vital nature.

Figure 2:
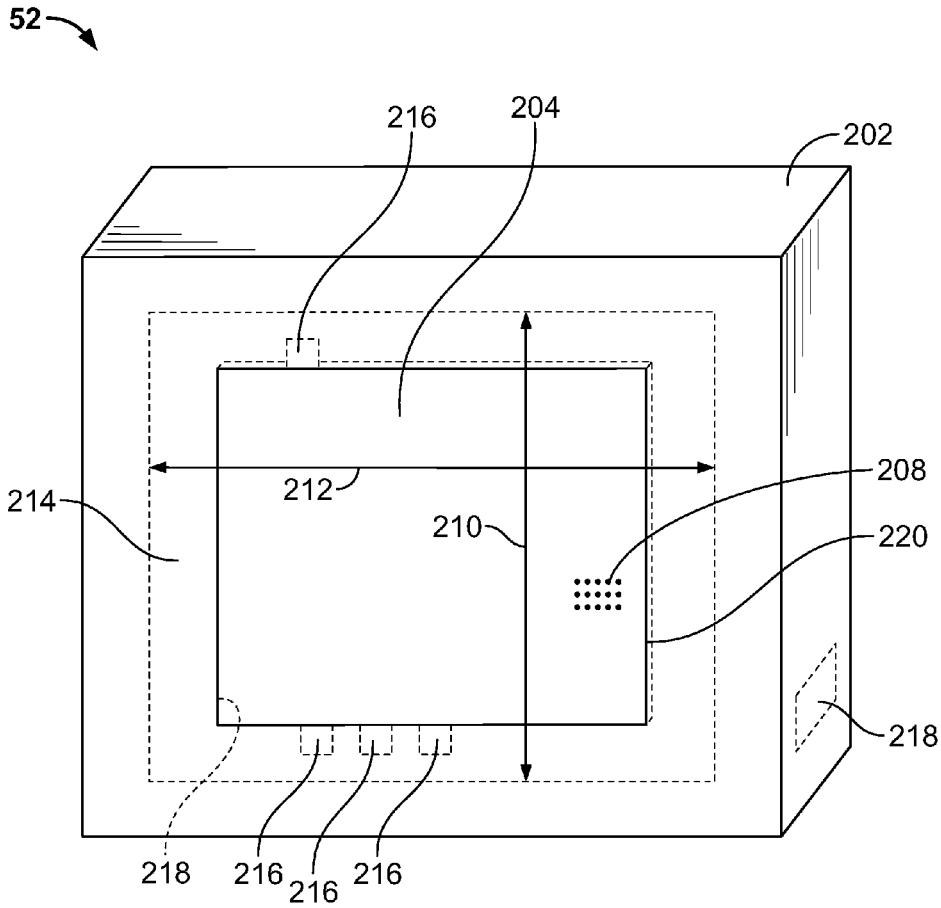

FIG. 2 is a perspective view of operator display system 52 (shown in FIG. 1) in accordance with an embodiment of the present invention. In the exemplary embodiment, operator display system 52 includes a housing 202 that includes a front aperture 204 for access to a screen surface 206. Screen surface 206 includes a plurality of luminous units 208 spaced across a height 210 and a width 212 of screen surface 206. Luminous units 208 may be formed of individual pixel elements such as but not limited to transistors or diodes to emit light when turned on. Luminous units 208 may also be formed of elements such as a liquid crystal display (LCD). Luminous units 208 may also be formed of phosphor areas of for example, a cathode ray tube (CRT) type screen that luminesces when struck by a directed electron. Aperture 204 includes a border 214 that extends over a periphery of screen surface 206. At least one sensor 216 is positioned in a gap between screen surface 206 and an inside surface of border 214. Sensor 216 is configured to receive light emitted by some of luminous units 208 that are displayed on screen surface 206. For example, one or more luminous units 208 may be addressed by a controller 218 to emit an amount of light. Sensor 216 receives the light if the luminous units 208 are within a field of view of sensor 216. When controller 218 generates a signal to turn on one or more luminous units 208, transmits the signal to particular luminous units 208 in a field of view of sensor 216, and receives a signal from sensor 216 that sensor 216 has received light from the addressed luminous units 208, controller 218 can determine that operator display system 52 is properly updating screen surface 206 and that other data displayed on screen surface 206 is current data.

Controller 218 may generate signals to one or more luminous units 208 causing luminous units 208 to emit light in a predetermined pattern. In a specific example, controller 218 may cause a group of ten luminous units 208 by ten luminous units 208 to travel around border 214 of screen surface 206, in a field of view of multiple sensors 216. If controller 218 receives signals from sensors 216 that the group of luminous units 208 are traveling around screen surface 206 in the predetermined pattern, controller 218 can determine that operator display system 52 is properly updating screen surface 206.

In an alternative embodiment, sensor 216 may include a plurality of sensors spaced along border 214 or may include a single sensor 220 that extends along substantially an entire side of aperture 204. Controller 218 may be embodied on a dedicated device such as a processor or logic circuit within operator display system 52 or may be a part of a related control system such as a general purpose computer that is programmed to perform the functions described herein and located remotely from operator display system 52.

During operation, to ensure that operator display system 52 is properly refreshing screen surface 206 with current data, controller 218 generates an icon that is displayed on screen surface 206 by energizing or otherwise causing one or more luminous units 208 to emit light. The icon may be a combination of luminous units 208 that form a recognizable symbol or pattern on screen surface 206. The luminous units 208 forming the icon are addressed by controller 218 using a coordinate system associated with the type of technology used to form screen surface 206. For example, an LCD display may use an X-Y or polar coordinate system and a CRT may use a line and time coordinate system to address luminous units 208. Sensor 216 receives the light emitted by luminous units 208 and controller 218 determines that screen surface 206 is operable. Sensor 216 may receive a pattern of light or image from luminous units 208 if for example, sensor 216 is a two dimensional sensor or may only receive a linear pattern if sensor 216 is a one dimensional sensor. If sensor 216 does not receive light emitted from the addressed luminous units 208 in a predetermined period, controller 218 generates an alert to inform a user that operator display system 52 is not being updated and that the data displayed on screen surface 206 may be inaccurate due to its age. The alert may include aural and/or visual components or may blank the screen by removing electrical power from screen surface 206 or operator display system 52. The screen may be also blanked by sending a predetermined pattern to screen surface 206 that is inconsistent with the display that is expected.

Figure 3:
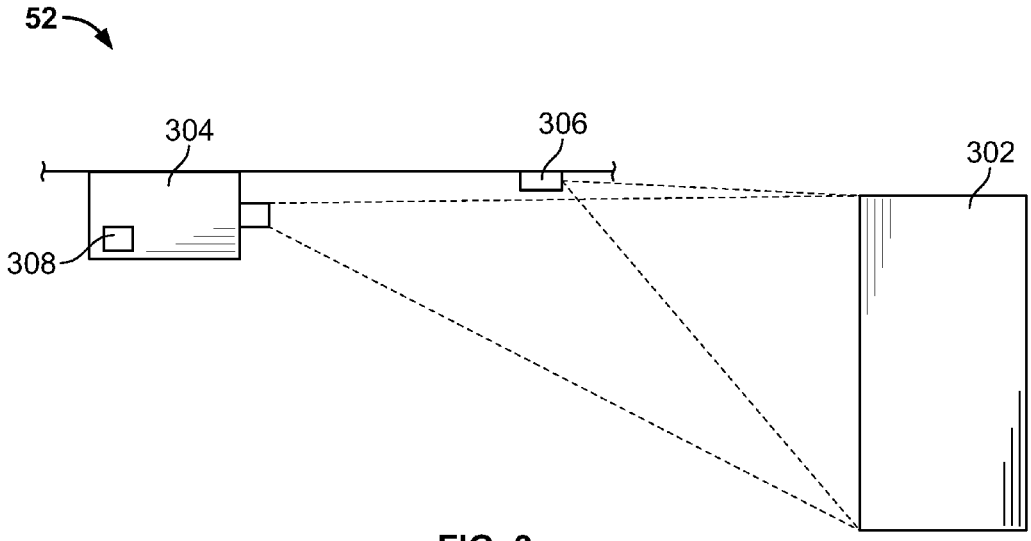

FIG. 3 is a perspective view of operator display system 52 (shown in FIG. 1) in accordance with another embodiment of the present invention. In the exemplary embodiment, operator display system 52 comprises a front projection screen 302 that luminesces by reflecting light projected onto it by a projector 304. In an alternative embodiment, operator display system 52 comprises a rear projection screen and associated projector (both not shown). Operator display system 52 also includes a sensor 306 that is configured to receive light directed from an icon projected onto a predetermined area of screen 302. A controller 308 associated with operator display system 52 is configured such as by programming to determine a location where the icon will be projected and to receive from sensor 306, an indication that the icon appeared on screen 302. If controller 308 does not receive the indication within a predetermined period of time, controller 308 generates an alert to inform a user, such alert may include blanking screen 302 by removing power from screen 302 or generating a display that is inconsistent with the current operating mode of operator display system 52.

The term controller, as used herein, refers to processors, central processing units, microprocessors, microcontrollers, reduced instruction set circuits (RISC), application specific integrated circuits (ASIC), logic circuits, and any other circuit or processor capable of executing the functions described herein.

As used herein, the terms "software" and "firmware" are interchangeable, and include any computer program stored in memory for execution by controller 218, including RAM memory, ROM memory, EPROM memory, EEPROM memory, and non-volatile RAM (NVRAM) memory. The above memory types are exemplary only, and are thus not limiting as to the types of memory usable for storage of a computer program.

As will be appreciated based on the foregoing specification, the above-described embodiments of the disclosure may be implemented using computer programming or engineering techniques including computer software, firmware, hardware or any combination or subset thereof, wherein the technical effect is monitoring a refresh of a display to ensure the information displayed is current and indicating an alert when the display is potentially not showing current data. Any such resulting program, having computer-readable code means, may be embodied or provided within one or more computer-readable media, thereby making a computer program product, i.e., an article of manufacture, according to the discussed embodiments of the disclosure. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The above-described embodiments of a method and system of maintaining vitality of a display system provides a cost-effective and reliable means for providing indication of when the display system is potentially not showing current data. More specifically, the methods and systems described herein facilitate displaying a known icon on the display and detecting that icon within a predetermined amount of time. If the icon is detected, the system assumes the display is properly refreshing. If the icon is not detected within the predetermined period of time, the system assumes that no information is being properly refreshed. The system then prevents the display from being relied upon by removing power form the display and/or signaling an alert. As a result, the methods and systems described herein facilitate automatically monitoring a display system in a cost-effective and reliable manner.

An exemplary methods and apparatus for automatically and continuously maintaining vitality of a display system are described above in detail. The apparatus illustrated is not limited to the specific embodiments described herein, but rather, components of each may be utilized independently and separately from other components described herein. Each system component can also be used in combination with other system components.

While the disclosure has been described in terms of various specific embodiments, it will be recognized that the disclosure can be practiced with modification within the spirit and scope of the claims.

What is claimed is:

1. A screen display system comprising:

a screen surface comprising a plurality of luminous units;

a controller communicatively coupled to said screen surface, said controller configured to address at least one of the plurality of luminous units; and a luminous unit sensor having a field of view comprising at least a portion of the screen surface, said luminous unit sensor configured to:

receive an image of the luminous units in the field of view;

transmit a signal to the controller in response to the received image; and determine that the screen surface is operable based on the signal received from the luminous unit sensor.

2. A system in accordance with claim 1 wherein said luminous unit comprises at least one of a discrete pixel element and a phosphorescent area.

3. A system in accordance with claim 1 wherein said controller is further configured to:

generate an icon for display on the screen surface;

determine an address to display the icon; and display the icon on the screen surface at the determined address.

4. A system in accordance with claim 1 wherein said controller is further configured to determine an address having a plurality of coordinates.

5. A system in accordance with claim 4 wherein each coordinate comprises a value that determines a position along the coordinate.

6. A screen display system comprising:

a screen surface comprising a plurality of luminous units;

a controller communicatively coupled to said screen surface, said controller configured to:

determine an address having a plurality of coordinates;

address at least one of the plurality of luminous units; and display one or more icons on the screen surface such that each of the plurality of coordinates is addressed within a predetermined period of time, and a luminous unit sensor having a field of view comprising at least a portion of the screen surface, said luminous unit sensor configured to receive an image of the luminous units in the field of view.

7. A system in accordance with claim 1 wherein said luminous unit sensor is configured to receive an image of an icon displayed on the screen surface within the field of view of the luminous unit sensor.

8. A screen display system comprising:

a screen surface comprising a plurality of luminous units;

a controller communicatively coupled to said screen surface, said controller configured to address at least one of the plurality of luminous units; and a luminous unit sensor having a field of view comprising at least a portion of the screen surface, said luminous unit sensor configured to:

acquire an image of an icon displayed on the screen surface; and receive an image of the luminous units in the field of view;

wherein said controller is configured to generate an alert when a time period between acquisitions of the icon exceeds a predetermined range.

9. A system in accordance with claim 8 configured to blank the display on the screen surface when a time period between acquisitions of the icon exceeds a predetermined range.

10. A method of monitoring the operability of a display comprising:

periodically displaying an icon on a screen surface;

acquiring an image of the displayed icon; and outputting an alert if the image of the icon is not acquired within a predetermined time period.

11. A method in accordance with claim 10 wherein periodically displaying an icon on a screen surface comprises determining an address of a location of the screen surface to display the icon.

12. A method in accordance with claim 10 wherein periodically displaying an icon on a screen surface comprises displaying an icon on a screen surface at a predetermined location on the screen surface.

13. A method in accordance with claim 12 wherein the a predetermined location is defined by one or more address coordinates and wherein periodically displaying an icon on a screen surface comprises sequentially displaying the icon at a plurality of locations such that each of the one or more address coordinates that define locations on the screen surface are used within a predetermined period of time.

14. A method in accordance with claim 10 wherein outputting an alert comprises blanking the screen surface.

15. A display system comprising:

a display device comprising a screen surface configured to display an icon;

a controller communicatively coupled to said display device, said controller configured to control the location of the display of the icon; and a display sensor configured to receive an image of the icon on the screen surface;

transmit a signal to the controller in response to the received image; and determine that the screen surface is operable based on the signal received from the display sensor.

16. A system in accordance with claim 15 wherein said screen surface comprises a plurality of at least one of a discrete pixel element and a phosphorescent area.

17. A system in accordance with claim 15 wherein said controller is further configured to:

generate at least one icon for display on the screen surface;

determine an address to display the at least one icon wherein the address comprises a plurality of coordinates; and display the at least one icon on the screen surface at the determined address.

18. A system in accordance with claim 15 wherein said controller is further configured to display one or more icons on the screen surface such that each of the plurality of coordinates is addressed within a predetermined period of time.

19. A system in accordance with claim 15 wherein said display sensor is configured to receive an image of an icon displayed on the screen surface.

20. A display system comprising:

a display device comprising a screen surface configured to display an icon;

a controller communicatively coupled to said display device, said controller configured to control the location of the display of the icon; and a display sensor configured to:

receive an image of the icon on the screen surface;

acquire an image of an icon displayed on the screen surface, wherein said controller is configured to generate an alert when a time period between acquisitions of the icon exceeds a predetermined range.

* * * * *